US010527317B2

(12) United States Patent
Yates

(10) Patent No.: US 10,527,317 B2
(45) Date of Patent: Jan. 7, 2020

(54) FLUID HEATING APPARATUS

(71) Applicant: Darrin Yates, Princeton, KY (US)

(72) Inventor: Darrin Yates, Princeton, KY (US)

( * ) Notice: Subject to any disclaimer, the term of this patent is extended or adjusted under 35 U.S.C. 154(b) by 409 days.

(21) Appl. No.: 15/410,783

(22) Filed: Jan. 20, 2017

(65) Prior Publication Data

US 2018/0209691 A1 Jul. 26, 2018

(51) Int. Cl.
*F24H 9/18* (2006.01)
*F24H 1/18* (2006.01)
*F24H 1/20* (2006.01)

(52) U.S. Cl.
CPC ..... *F24H 9/1818* (2013.01); *F24H 1/182* (2013.01); *F24H 1/202* (2013.01)

(58) Field of Classification Search
CPC .... F24H 9/1818; F24H 9/1809; F24H 9/1827; F24H 9/1863; F24H 9/1872; F24H 9/12; F24H 9/122; F24H 9/126; F24H 9/128; F24H 9/14; F24H 9/146; F24H 1/182; F24H 1/202; F24H 1/207
See application file for complete search history.

(56) References Cited

U.S. PATENT DOCUMENTS 3,854,454 A * 12/1974 Lazaridis ..... F24H 1/20 122/33
4,883,943 A 11/1989 Davis
6,143,217 A * 11/2000 Jackson ..... B29C 44/1247 264/139
6,810,206 B1 10/2004 Clark, Jr.
2012/0175358 A1 7/2012 Davidson, Jr.

* cited by examiner

*Primary Examiner* — Shawntina T Fuqua
(74) *Attorney, Agent, or Firm* — Roger A. Jackson

(57) ABSTRACT

A fluid heating apparatus for a primary fluid system the apparatus including first and second surrounding sidewalls having respective first and second interiors disposed therein connected through a first aperture, with a selectable first fluid communication from the primary fluid system to the first and second interiors with a selectable second fluid communication to a secondary consumption fluid system. The apparatus additionally includes a heater that is disposed within both the first and second interiors, wherein operationally a fluid is disposed within the primary fluid system, the first interior, and the second interior, wherein the heater initially heats the fluid within the first and second interiors such that through warmed/cooler fluid density differences causing a warmed fluid heat transfer to the primary fluid system wherein the fluid once cooled returns to the first and second interiors to be re-warmed and returned to the primary fluid system.

18 Claims, 10 Drawing Sheets

FLUID HEATING APPARATUS

TECHNICAL FIELD

The present invention relates generally to selective fluid heating of an apparatus for storing liquids or fluids for various uses. More specifically, the present invention relates to an apparatus that can be constructed of removably engagable segments for selectively assembling a fluid heating appliance that is removably engagable to the fluid storage apparatus with a multitude of fluid volumetric capacities and physical-structural configurations depending upon the application involved that accommodates servicing (repair/replace) the of the heating appliance without disturbing the fluid disposed within the apparatus.

BACKGROUND OF INVENTION

The needs for fluid storage vessels are numerous going from general industrial/commercial, to process plants, and residential uses. There are a multitude of various fluids that need to be contained with their accompanying temperatures and pressures, thus creating a wide range of fluid storage vessel applications. Further, fluid storage vessel applications also typically require that the vessel be horizontally or vertically mounted; being mounted above ground, on the ground surface, or below ground. When vessels become large, i.e. storing thousands of gallons of fluid, wherein the vessel is literally large enough to allow an individual to walk inside, the stresses that the vessel experiences are quite large in magnitude. These stresses result from several areas; first from differential force or pressure loading from the weight and/or the inherent pressure of the fluid disposed within the vessel, second from the weight of the medium that is external to the vessel (i.e. such as a vessel is buried within the earth below the ground surface), third from contact with the structural supports that hold the vessel in a desired position, and fourth from the various fluid connections causing attachment moments through the vessel wall.

However, the primary vessel stresses of concern are the differential wall forces that the vessel experiences, from the weight or pressure of the fluid disposed within the vessel interior or the weight or pressure of the external medium acting against the external walls of the vessel (i.e. for example in the case of a vessel buried beneath the ground surface). For a typical vessel, the basic shape is that of a cylinder which from the interior of the vessel experiences basically two types of stress; the first being the hoop stress and second being the axial or long stress. Hoop stress is the force against the curved sidewalls of the vessel which project in a flat plane of area roughly equal to a lengthwise cut through the vessel and grow with increases in the diameter. Long stress is perpendicular to the hoop stress being the force against the ends of the vessel that is parallel to the longitudinal axis of the cylinder. For a given cylinder shape the hoop stresses increase with the diameter of the cylinder, wherein the long stress is not a function of cylinder length along the longitudinal axis.

This cylinder stress relationship between the hoop and long stresses leads to some optimal configurations for cylinders depending upon the application, such that a cylinder containing a higher internal pressure is optimally small in diameter and longer in length, as the diameter increases high wall stress (i.e. larger diameter equals higher stress) wherein a longer length cylinder does not add to wall stress. Thus a cylinder that is short in length and a cylinder that is long in length experience the same wall stress from internal loads.

The key to adding internal volumetric storage capacity is to keep the diameter minimal and to gain the internal volumetric capacity from increases in cylinder length, although the aforementioned long stresses must be considered that come with a longer small diameter cylinder design. As for forces external to the vessel cylinder, that magnitude of the forces are similar to internal cylinder pressure, (i.e. a larger diameter increases the external forces, while increases in cylinder length do not add to the external forces in the horizontal position). However, the wall stress effect on the cylinder from internal versus external force are different, as the external compression forces such as earth loading introduce bending moments in the vessel wall that can complicate the strength analysis, as opposed to the more pure tension stresses that internal fluid loads create on the wall of the vessel.

In so far as the materials of construction are concerned for vessels, various materials have been used in the past to construct vessels all having various advantages and disadvantages. In the past, the more common materials of construction have been steel and concrete, however fiberglass is gaining more and more popularity especially due to its anti-corrosion properties as against the internal fluid as well as any external medium. Steel tanks are typically prone to rusting, (unless they are constructed of stainless steel, which is typically not done due to high cost) especially when exposed to groundwater or above ground wet weather. Concrete does not rust of course, but may develop hair line fractures and is typically porous in nature leading to issues with absorbing internal fluids and deterioration over time. Fiberglass has good resistance to corrosion, but is relatively brittle, requiring careful handling, especially during shipping and installation. A sharp blow or inadvertent vessel point contact can easily cause considerable damage to a fiberglass vessel.

Both steel and concrete tanks are relatively heavy. This typically results in the tanks being constructed near or at the point of installation to reduce the energy cost of transportation and related installation difficulties. The weight of steel and concrete vessels effectively limits the maximum size of a vessel which can be transported by common carriers over the interstate highways or railroads. On-site or field construction greatly adds to the labor cost and time required for such steel or concrete vessels. Fiberglass has some attractiveness in this area as a much lighter material which can be used to mass produce vessels in a controlled factory environment. A fiberglass vessel can be relatively large, light weight, and easier to ship and install. However, considering the prior difficulties associated with dropping, bumping, or impacting the relatively brittle fiberglass vessel can be difficult to overcome, especially since the repair of a damaged fiberglass vessel on-site can be technically difficult and costly.

An alternative vessel construction material is a high density Polyethylene which offers many of the positive aspects of fiberglass, such as the light weight and anti-corrosive properties. Polyethylene vessels are typically formed into cylindrical type shapes using a rotary molding process which produces a one-piece, seamless tank. The advantages of polyethylene are its softer and more flexible nature as compared to fiberglass. Polyethylene vessels are far more impact resistant and will flex rather than crack when the polyethylene vessel is subjected to shipping and installation irregularities, bumping and so on, as previously described. However, the drawback of this softer polyethylene material is that it is structurally weaker, which is a major design consideration. Looking at the aforementioned discussion related to vessel stresses, the polyethylene lower flexural modulus issue must be dealt with carefully in the design process.

The shipment of factory made vessels is severely limited to what a typical a flatbed truck can carry. In many situations the internal volume or internal capacity required often exceeds the shipping size that a flatbed truck can effectively deliver. One solution is the use of segmented vessels, wherein a number of smaller modules can be assembled together to add the desired internal volumetric capacity. However, a vessel's segmented construction presents assembly, alignment, and fluid sealing issues that must be dealt with at the location where the tank is to be installed.

The present invention deals with an apparatus to selectively heat primarily water storage vessels that are utilized for water storage used for fire protection, drinking, and a multitude of other uses, wherein the vessel is typically an on-site built type constructed of steel with a concrete foundation with the vessel being ground surface mounted and shaped as a vertically oriented cylinder that is fairly large in volume being in the hundreds of thousands of gallons range.

As the availability of the stored water is paramount year round, in geographic areas where the environmental air temperature can drop below freezing, provisions must be made for keeping the stored water from freezing being either thermal or chemical, wherein for maximum applications for use, the thermal route is most often used as manifested by a water heating appliance that can be fuel based or electrically based. Fuel based heaters are usually more efficient but have higher initial cost and higher installation cost, whereas electrically based heaters are usually less efficient, however, having lower initial cost and lower installation cost. Thus resulting in the economies such that a heater that is occasionally used would be typically an electric heater and a heater that is fairly continuously used would be typically be a fuel based heater, such that for a seasonal use tank water heater (being an occasional use for winter months only) would normally be an electric based water heater.

In analyzing the above, there are numerous ways to accomplish water tank heating, depending upon the severity of the potential water freezing, the type of tank (size, construction, configuration, etc.), the use of the tank water, cost, installation, and maintenance issues. What follows are some examples of tank heaters in the prior art having different applications or uses and their accompanying differing heater mounts, installation, and maintenance issues.

In looking at the prior art in this area, in U.S. Pat. No. 4,883,943 to Davis disclosed is an electric heater for a fuel tank that is disposed within the tank drain (outlet) in an application for a diesel truck to prevent cold weather fuel waxing as this is the most common application wherein the heater is located within the tank outlet, with the diesel fuel warmed at the point wherein it is pumped into the diesel engine injectors. In looking at FIGS. 1, 3, and 4, of Davis the heater is positioned in the outlet of the tank, however, it is also partially disposed within the tank interior volume itself, also heater rod replacement would require tank fluid or fuel draining, which on a vehicle probably is not as big of deal, as it would be a more difficult proposition in a very large permanent ground surface mounted storage tank.

Continuing, in the tank heater prior art in U.S. Pat. No. 6,810,206 to Clark, Jr., disclosed is a drain plug mounted heater for an application or field of use in livestock water tanks that typically have an open top, wherein it is convenient to mount the heater in the drain opening, however, noting that the heater is an immersion type, i.e. such that it is merely using the drain port opening to physically mount the heater while the heater is immersed into the tank interior. The primary novelty in Clark is in the plug being able to pass therethrough the relatively small drain opening, however, the heater being much larger that the tank drain opening size, pointing to the advantage of an open top smaller tank, wherein the tank can be drained and the heater installed from inside the tank from the open tank top.

Next, in the tank heater prior art field in United States Patent Application Publication Number 2012/0175358 to Davidson, Jr., disclosed is an automotive engine oil pan drain plug heater, being the other common heater in the tank drain application, wherein the heater threads into the oil tank drain for keeping the oil viscosity lower in cold weather, wherein the heater inserts into the tank interior from the outside therethrough the drain opening, thus requiring removal of the heater to drain and change the oil from the oil tank.

What is needed is a relatively small-truck transportable, lightweight, segmented modular type enclosure that can be easily transported and installed in its permanent location while easily fitting on a typical truck with the assembled segments being light in weight and small enough in size to avoid high capacity crane and specialized rigging equipment being required for the tank heater installation and maintenance. Further, issues that need to be addressed are the additional problems of alignment, attachment, and sealing that accompany a segmented apparatus enclosure design suitable for fast field assembly, wherein the apparatus supports and contains the heater being in fluid communication with the tank fluid. Further, the apparatus can accommodate heater removal and re-installation of the heater for maintenance reasons without the need to disturb or drain the fluid in the tank. Another desirable benefit of the heater/apparatus assembly would be to enhance the thermal effect of the heater disposed within the apparatus via the fluid communication with the tank fluid to diffuse the heater output into the tank fluid using thermal conduction and convection primarily to increase the efficiency of the heater. Thus in summary, the heater is disposed completely outside of the interior tank volume and that the heater can be serviced or replaced without draining the tank fluid, while at the same time providing adequate heating to facilitate water flow from the tank in freezing exterior temperatures.

SUMMARY OF INVENTION

Broadly, the present invention is an enclosure that includes a fluid heating apparatus for a primary fluid system containing a fluid, the fluid heating apparatus including a first surrounding sidewall having a first outer portion and an opposing first inner portion, with the first surrounding sidewall being about a longitudinal axis, the first surrounding sidewall having a first proximal end portion and an opposing first distal end portion with the longitudinal axis spanning therebetween. The first surrounding sidewall first proximal end portion, first inner portion, and first distal end portion defining a first interior, wherein the first proximal end portion is adapted to facilitate a first fluid communication from the primary fluid system therethrough a drain of the primary fluid system to the first interior and the first distal end portion is adapted to facilitate a selectable second fluid communication to a secondary consumption fluid system from the first interior. Wherein the selectable second fluid communication has a selectable open state and a selectable closed state to the secondary fluid consumption system, the first surrounding sidewall also including a first aperture disposed therethrough from the first outer portion to the first inner portion, also the first aperture being about a lengthwise axis, with the lengthwise axis being disposed therethrough the first aperture wherein the lengthwise axis intersects the longitudinal axis a first intersection point.

The fluid heating apparatus further includes a second surrounding sidewall having a second outer portion and an opposing second inner portion, with the second surrounding sidewall being about the lengthwise axis, the second surrounding sidewall having a second proximal end portion and an opposing second distal end portion with the lengthwise axis spanning therebetween. The second proximal end portion, second inner portion, and second distal end portion defining a second interior, the second proximal end portion is affixed to the first surrounding sidewall such that there is a third fluid communication between the first interior and the second interior therethrough the first aperture.

The fluid heating apparatus additionally includes a means for imparting heat energy that is disposed within both the first interior and the second interior, wherein operationally the fluid is disposed within the primary fluid system, the first interior, and the second interior. Wherein the means for imparting heat energy initially directly heats the fluid within the first and second interiors thereby causing a warmed fluid heat transfer convection through heat transfer conduction causing advection via thermal expansion of the fluid causing buoyancy forces within the fluid resulting in a natural convection created from a reduction in density of the directly heated fluid relative to a lower density of the non-directly heated fluid thus causing fluid circulation from the first and second interiors to the primary fluid system wherein the fluid heat dissipates increasing the fluid density thus facilitating return of a portion of the fluid from the primary fluid system to the first and second interiors to form a circulation loop to dissipate the heat energy from the means to the primary fluid system.

These and other objects of the present invention will become more readily appreciated and understood from a consideration of the following detailed description of the exemplary embodiments of the present invention when taken together with the accompanying drawings, in which;

BRIEF DESCRIPTION OF DRAWINGS

FIG. 5 is a close up perspective view of FIG. 4, wherein FIG. 5 shows the present invention of the fluid heating apparatus that includes the exterior of a primary fluid system with the drain, the drain valve, and the fluid vessel, wherein the drain valve is in selectable fluid communication with the secondary fluid consumption system (not shown), further shown on the fluid heating apparatus is the means for imparting heat energy to the fluid in the form of an electric resistance heater with a temperature sensor for the fluid;

FIG. 6 is an alternative perspective view of FIG. 5, wherein FIG. 6 shows the present invention of the fluid heating apparatus that includes the exterior of a primary fluid system with the drain, the drain valve, and the fluid vessel, wherein the drain valve is in selectable fluid communication with the secondary fluid consumption system (not shown), further shown on the fluid heating apparatus is the means for imparting heat energy to the fluid in the form of an electric resistance heater;

FIG. 7 shows view 7-7 from FIG. 5, wherein FIG. 7 shows in particular the temperature sensor and the means for reducing heat transfer in the form of a fiberglass mat layer surrounded by a weatherproof outer cover all as disposed in the drain valve area and the fluid heating apparatus area;

REFERENCE NUMBERS IN DRAWINGS

Figure 1:
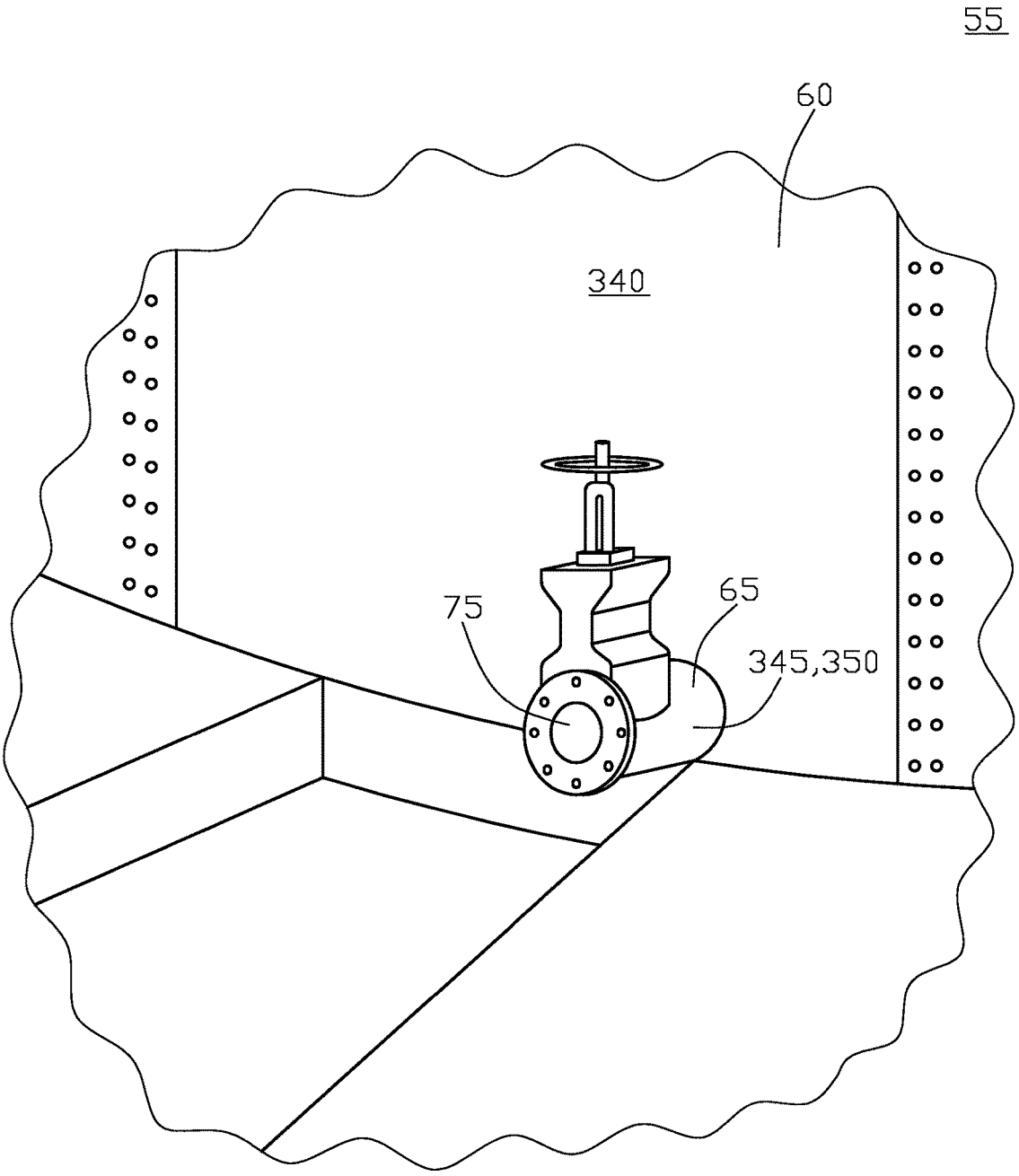
Prior Art Fig. 1
FIG. 1 shows an example of a prior art arrangement of an exterior of the primary fluid system that includes a drain, a drain valve, and a fluid vessel, wherein the drain valve is in selectable fluid communication with a secondary fluid consumption system (not shown)

50 Fluid heating apparatus
55 External environment
60 Primary fluid 60 system
65 Drain of the primary fluid 70 system 60
70 Fluid, can be any fluid that is adaptable to heating to result in a desired property or properties

75 Secondary fluid 70 consumption system, such as fire suppression, water for human use or consumption, agriculture, industrial, and the like
80 Second fluid 70 communication between the secondary fluid consumption system 75 and the first interior 155
85 Selectable second fluid communication 80 preferably via a valve
90 Open state of the selectable second fluid communication 85
95 Closed state of the selectable second fluid communication 85
100 First surrounding sidewall
105 First outer portion of the first surrounding sidewall 100
110 First inner portion of the first surrounding sidewall 100
115 Longitudinal axis of the first surrounding sidewall 100
120 First proximal end portion of the first surrounding sidewall 100
125 First proximal flange of the first surrounding sidewall 100
130 First distal end portion of the first surrounding sidewall 100
135 First distal flange of the first surrounding sidewall 100
140 Larger diameter pipe section of the first surrounding sidewall 100
145 First axial length of the first surrounding sidewall 100
150 First diameter of the first surrounding sidewall 100
155 First interior of the first surrounding sidewall 100 of the first surrounding sidewall 100
160 First fluid 70 communication being from the primary fluid 70 system 60 to the first interior 155 therethrough the drain 65
165 First aperture of the first surrounding sidewall 100
170 Lengthwise axis of the first aperture 165
175 First intersection point of the lengthwise axis 200 and the longitudinal axis 115
180 Substantially perpendicular position of the lengthwise axis 200 and the longitudinal axis 115 at the first intersection point 175
185 Second surrounding sidewall
190 Second outer portion of the second surrounding sidewall 185
195 Second inner portion of the second surrounding sidewall 185
200 Lengthwise axis of the second surrounding sidewall 185
205 Second proximal end portion of the second surrounding sidewall 185
210 Second proximal flange of the second surrounding sidewall 185
215 Second distal end portion of the second surrounding sidewall 185
220 Second distal flange of the second surrounding sidewall 185
225 Smaller diameter pipe section of the second surrounding sidewall 185
230 Second diameter of the second surrounding sidewall 185
235 Second axial length of the second surrounding sidewall 185
240 Second interior of the second surrounding sidewall 185
245 Second proximal end portion affixed to the first surrounding sidewall 100
250 Third fluid communication between the first interior 155 and the second interior 240 therethrough the first aperture 165
255 First aperture flange is affixed to the second proximal flange 210
260 Means for imparting heat energy that is disposed within the first 155 and second 240 interiors
265 Electric resistance heater for the means 260
270 Heating element of the electric resistance heater 265
275 Electric resistance heater that is removably engaged to the second distal flange 220
280 Directed heated fluid 70 (lowest fluid 70 density)
285 Indirectly heated fluid 70 (lower fluid 70 density)
290 Warmed fluid 70 heat transfer convection
295 Fluid circulation from the first 155 and second 240 interiors to the primary fluid system 60
300 Buoyancy forces within the fluid 70 from the lower fluid density
305 Fluid heat dissipates in the primary fluid system 60 dropping fluid 70 density (higher fluid 70 density)
310 Return of a portion of the fluid 70 from the primary fluid system 60 to the first 155 and second 240 interiors
315 Circulation loop essentially dissipating the heat energy from the means 260 for imparting heat energy to the primary fluid system 60
320 Means for reducing heat transfer
325 Fiberglass mat layer of the means 320
330 Weatherproof outer cover of the means 320
335 Fluid heating apparatus system
340 Primary feed fluid 70 vessel
345 Drain connection of the primary feed fluid 70 vessel 340
350 Drain valve of the drain connection 345 having an open state for fluid 70 communication between the primary fluid system 60 and the secondary fluid 70 consumption system 75 through the fluid heating apparatus 50 and the closed state to prevent fluid communication between the primary fluid system 60 and the secondary fluid 70 consumption system 75
355 First proximal end portion 120 affixed to the drain 345 of the vessel 340
360 Temperature sensor for the fluid 70 in the drain 345
400 Prior art fluid 70 heater

DETAILED DESCRIPTION

Figure 2:
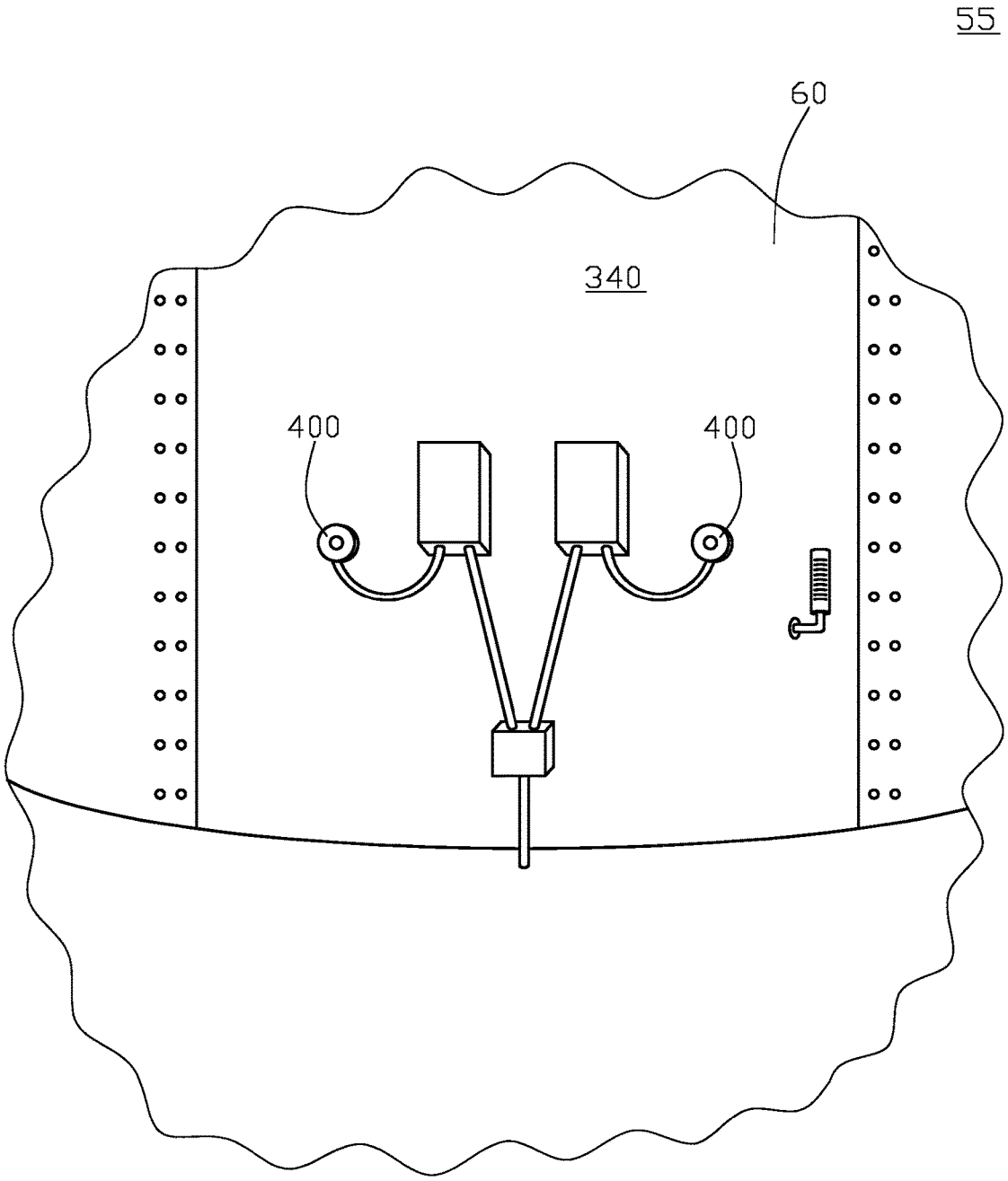
Prior Art Fig. 2
FIG. 2 also shows the primary fluid system of FIG. 1 with a focus on the prior art heaters for the vessel viewed externally.
Figure 3:
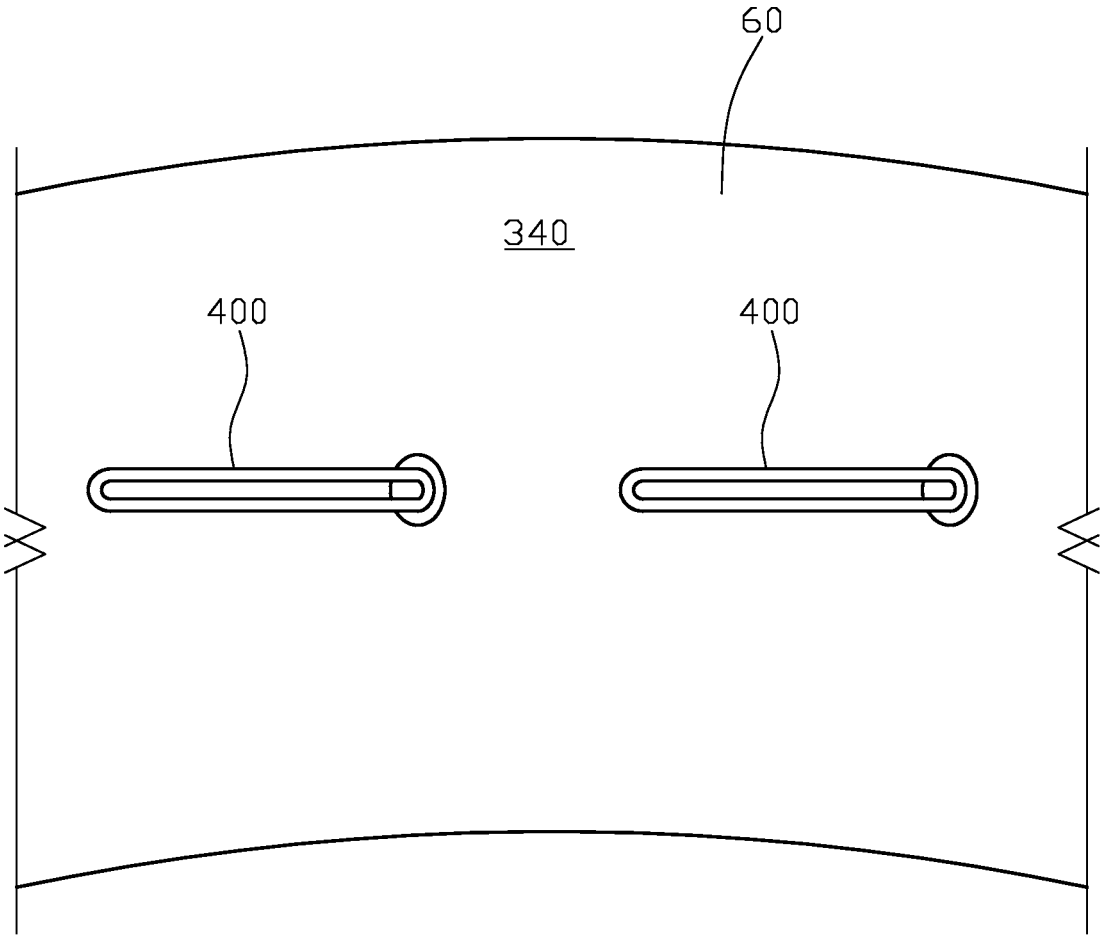
Prior Art Fig. 3
FIG. 3 also shows the primary fluid system of FIG. 2 with a focus on the prior art heaters for the vessel viewed internally with the prior art heaters disposed within the main body of the vessel itself.

With initial reference to FIG. 1 shown is an example of a prior art arrangement of an exterior 55 of a primary fluid system 60 that includes a drain 65, a drain valve 350, and a fluid vessel 340, wherein the drain valve 350 is in selectable fluid communication with a secondary fluid consumption system 75 (not shown);

Continuing, FIG. 2 also shows the primary fluid system 60 of FIG. 1 with a focus on the prior art heaters 400 for the vessel 340 viewed externally 55. Next, FIG. 3 also shows the primary fluid system 60 of FIG. 2 with a focus on the prior art heaters 400 for the vessel 340 viewed internally with the prior art heaters 400 disposed within the vessel 340 body itself.

Figure 4:
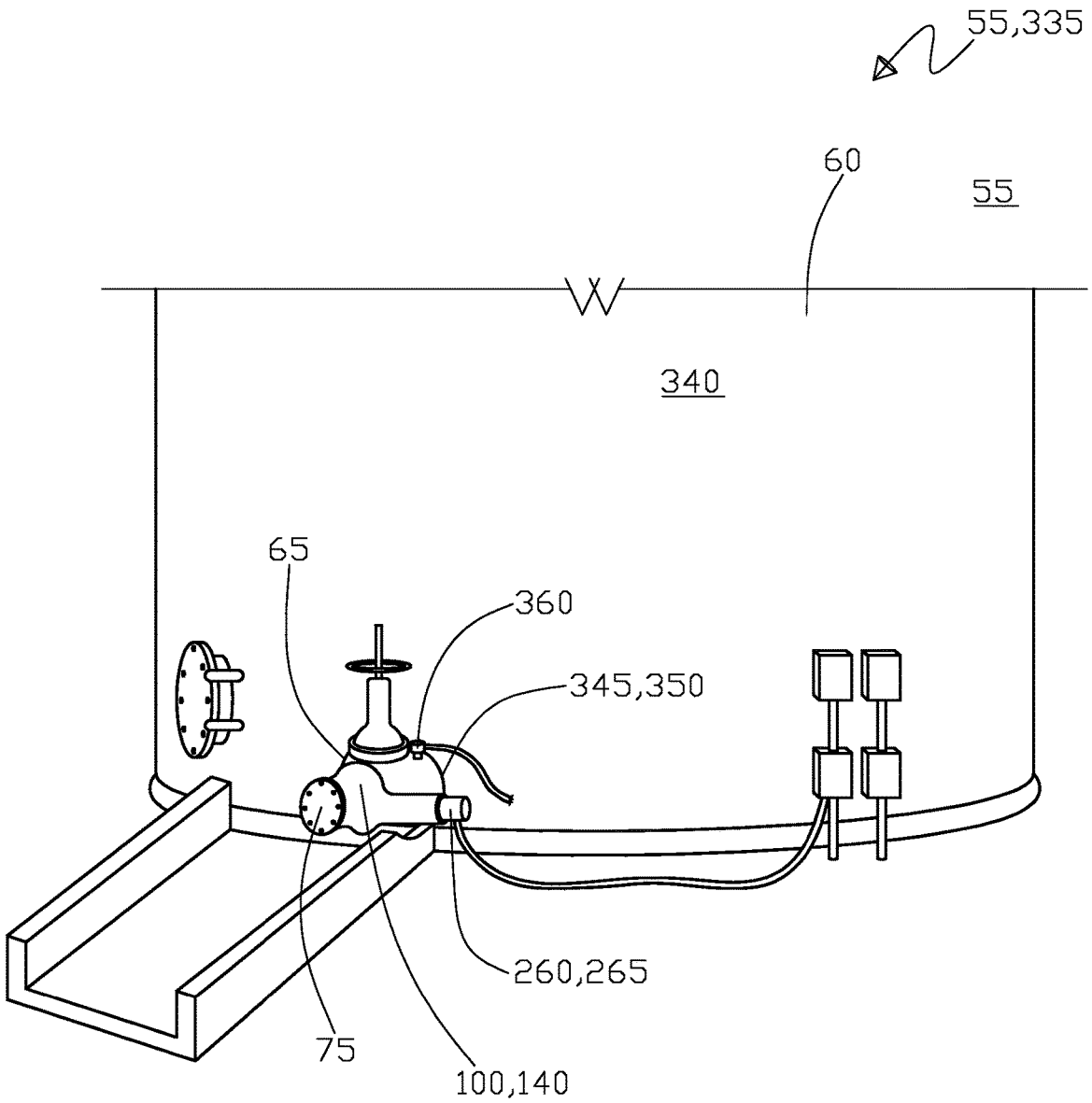
FIG. 4 shows an example of the present invention of the fluid heating apparatus that includes the exterior of a primary fluid system with the drain, the drain valve, and the fluid vessel, wherein the drain valve is in selectable fluid communication with the secondary fluid consumption system (not shown), further shown on the fluid heating apparatus is a means for imparting heat energy to the fluid in the form of an electric resistance heater with a temperature sensor for the fluid.

Further, FIG. 4 shows an example of the present invention of the fluid heating apparatus 50 that includes the exterior 55 of a primary fluid system 60 with the drain 65, the drain valve 350, and the fluid vessel 340, wherein the drain valve 350 is in selectable fluid communication with the secondary fluid consumption system 75 (not shown), further shown on the fluid heating apparatus 50 is a means 260 for imparting heat energy to the fluid 70 in the form of an electric resistance heater 265 with a temperature sensor 360 for the fluid 70 for heater 265 control.

Figure 5:
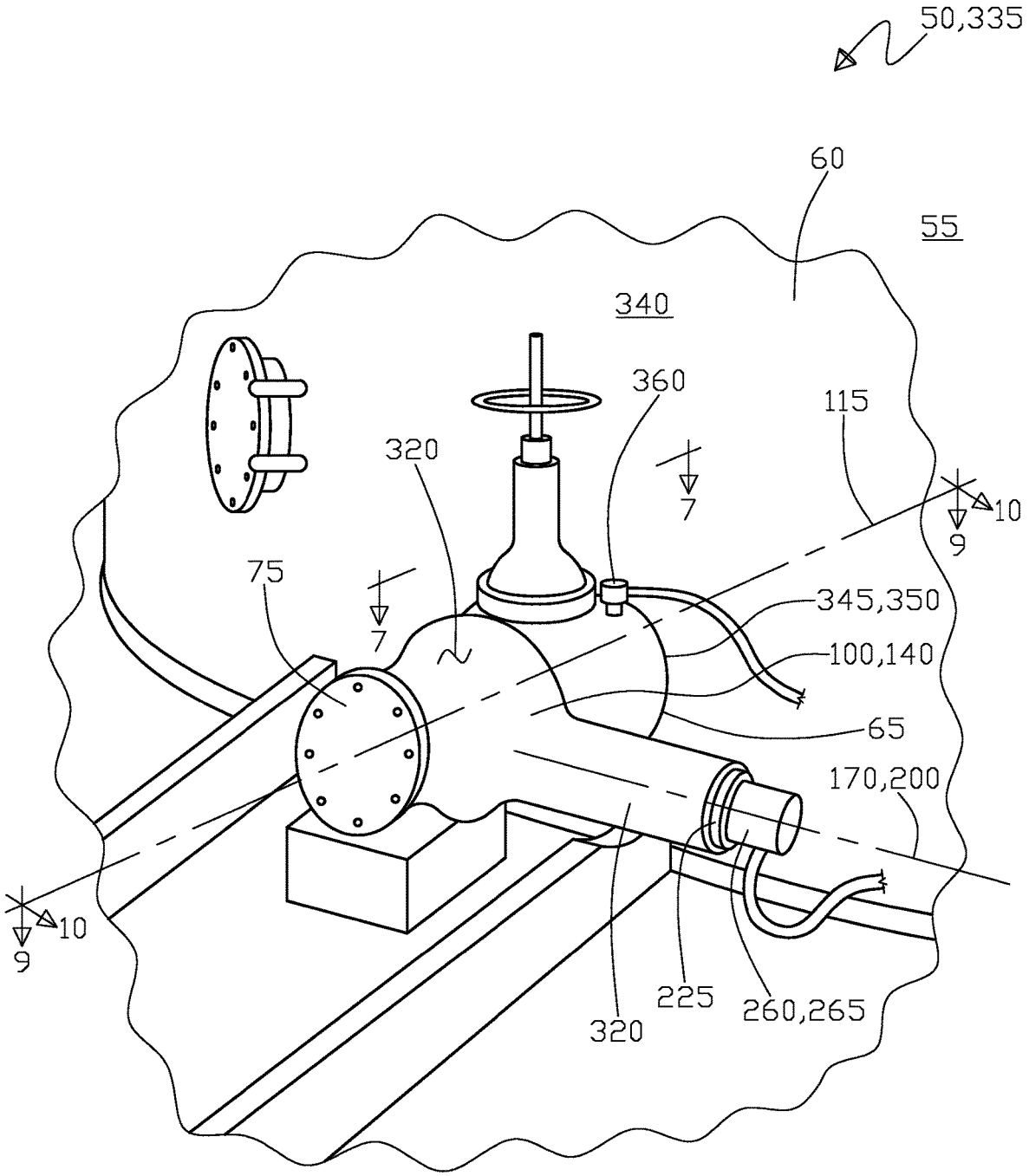

Next, FIG. 5 is a close up perspective view of FIG. 4, wherein FIG. 5 shows the present invention of the fluid heating apparatus 50 that includes the exterior 55 of a primary fluid system 60 with the drain 65, the drain valve 350, and the fluid vessel 340, wherein the drain valve 350 is in selectable fluid communication with the secondary fluid consumption system 75 (not shown), further shown on the fluid heating apparatus 50 is the means 260 for imparting heat energy to the fluid 70 in the form of an electric resistance heater 265 with a temperature sensor 360 for the fluid 70.

Figure 6:
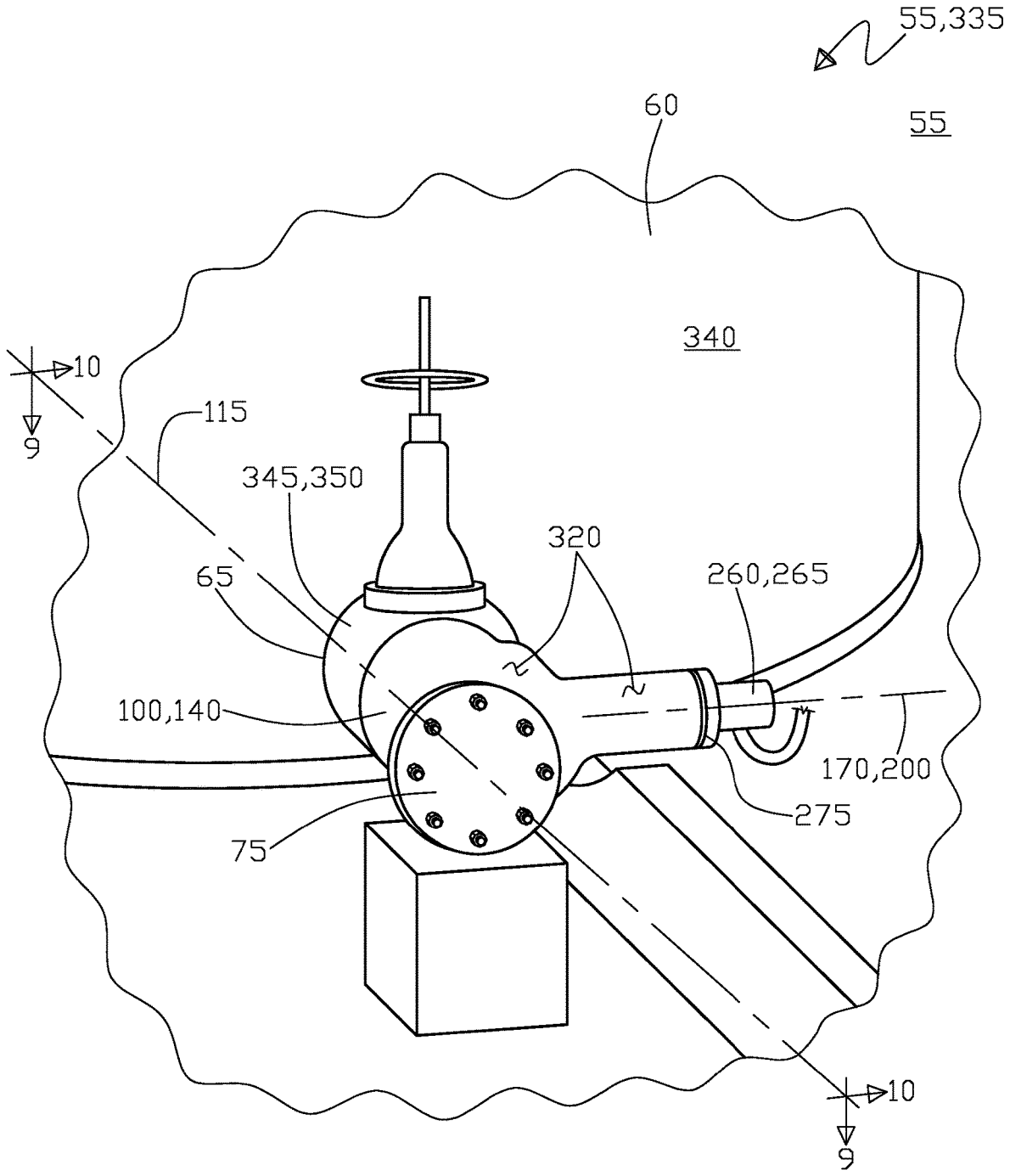

Yet further, FIG. 6 is an alternative perspective view of FIG. 5, wherein FIG. 6 shows the present invention of the fluid heating apparatus 50 that includes the exterior 55 of a primary fluid system 60 with the drain 65, the drain valve 350, and the fluid vessel 340, wherein the drain valve 350 is in selectable fluid communication with the secondary fluid consumption system 75 (not shown), further shown on the fluid heating apparatus 50 is the means 260 for imparting heat energy to the fluid 70 in the form of an electric resistance heater 265.

Figure 7:
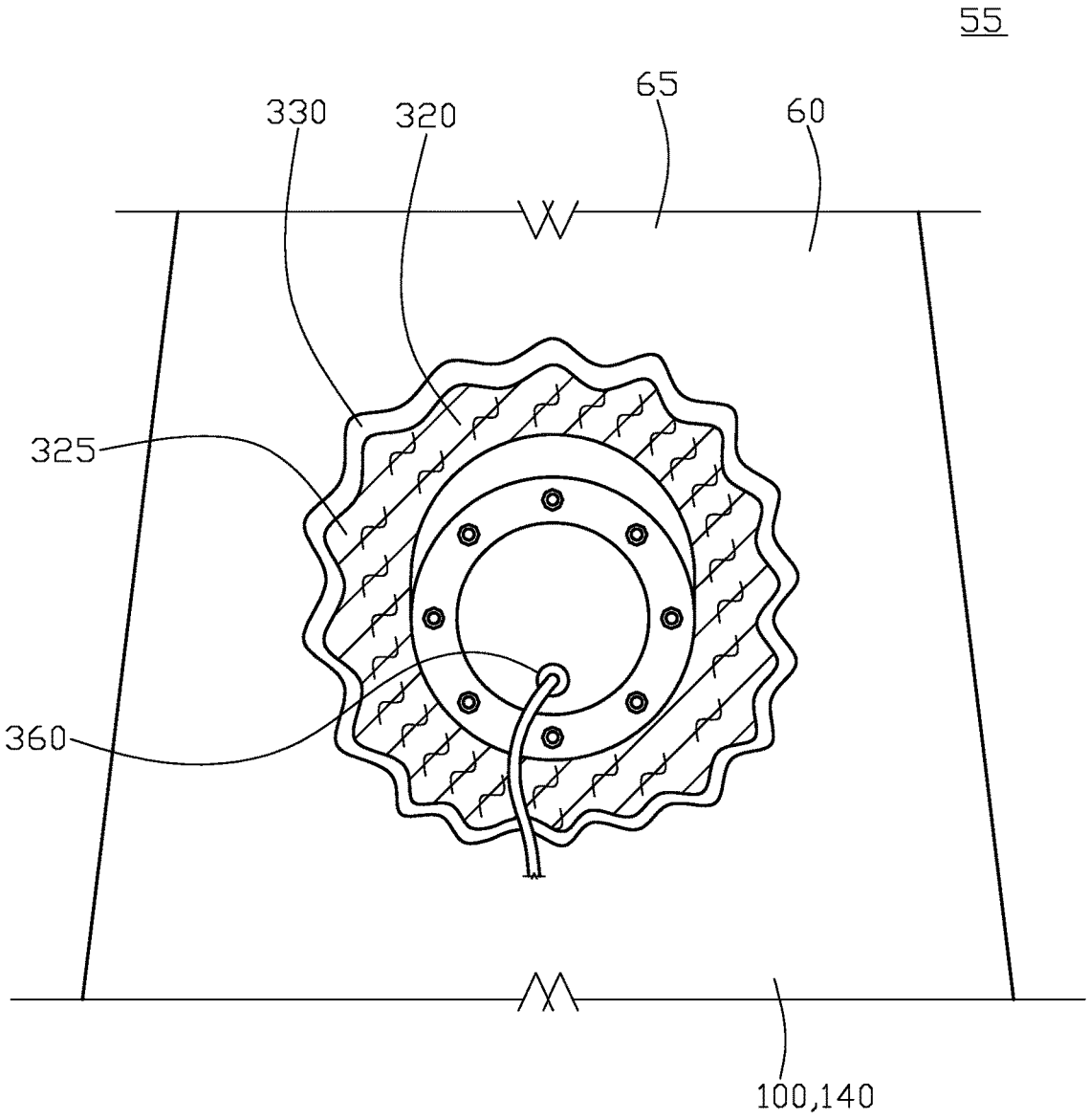

Continuing, FIG. 7 shows view 7-7 from FIG. 5, wherein FIG. 7 shows in particular the temperature sensor 360 and the means 320 for reducing heat transfer in the form of a fiberglass mat layer 325 surrounded by a weatherproof outer cover 330 all as disposed in the drain valve 350 area and fluid heating apparatus 50 area.

Figure 8:
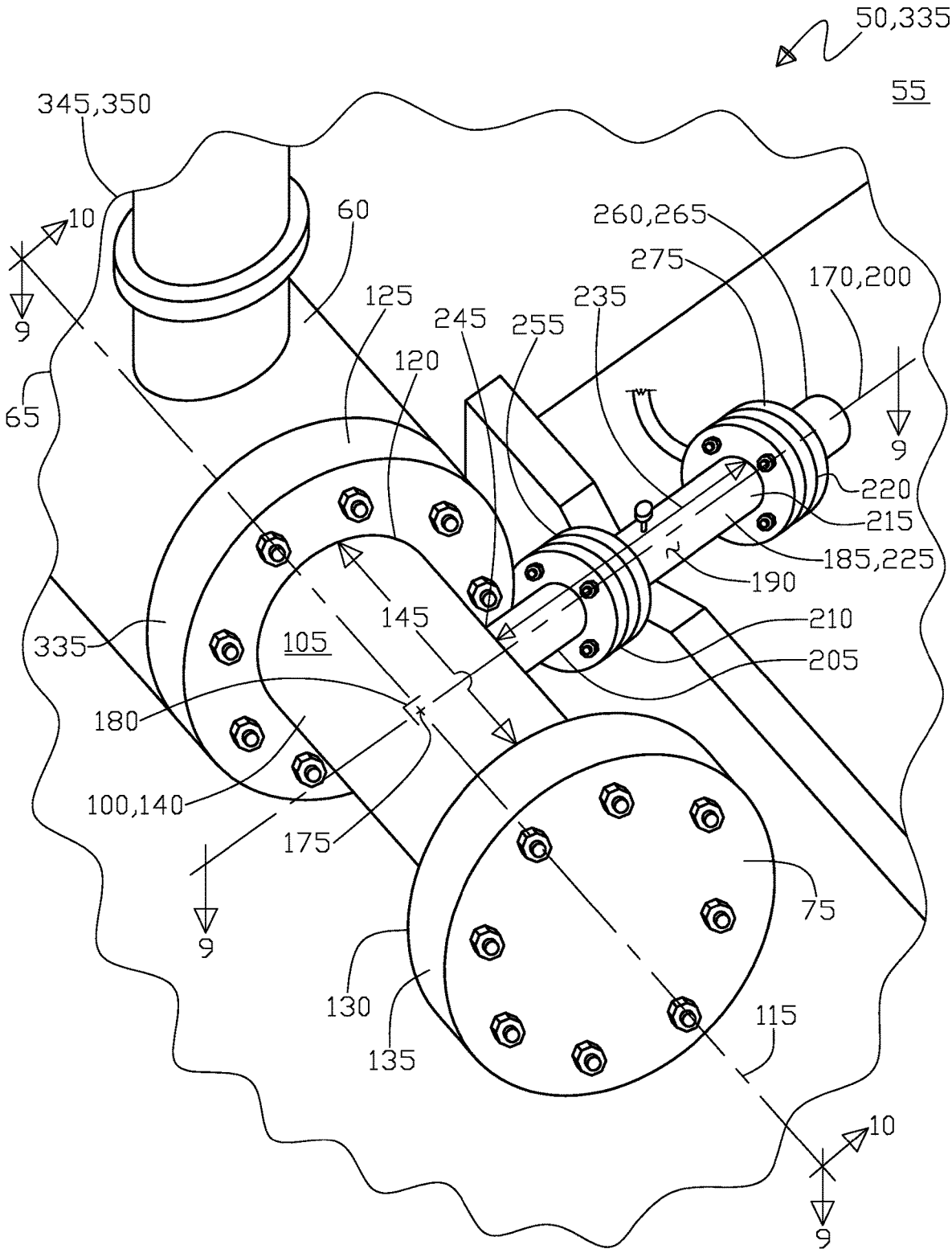
FIG. 8 is a close up of an upper perspective view of the present invention of the fluid heating apparatus that includes the exterior of a primary fluid system with the drain, and the drain valve, wherein the drain valve is in selectable fluid communication with the secondary fluid consumption system (not shown), further shown on the fluid heating apparatus is the means for imparting heat energy to the fluid in the form of an electric resistance heater along with the first and second surrounding sidewalls, the first and second proximal end portions, with the first and second distal end portions.

Also, FIG. 8 is a close up of an upper perspective view of the present invention of the fluid heating apparatus 50 that includes the exterior 55 of a primary fluid system 60 with the drain 65, and the drain valve 350, wherein the drain valve 350 is in selectable fluid communication with the secondary fluid consumption system 75 (not shown), further shown on the fluid heating apparatus 50 is the means 260 for imparting heat energy to the fluid 70 in the form of an electric resistance heater 265 along with the first 100 and second 185 surrounding sidewalls, the first 120 and second 205 proximal end portions, with the first 130 and second 215 distal end portions all shown.

Figure 9:
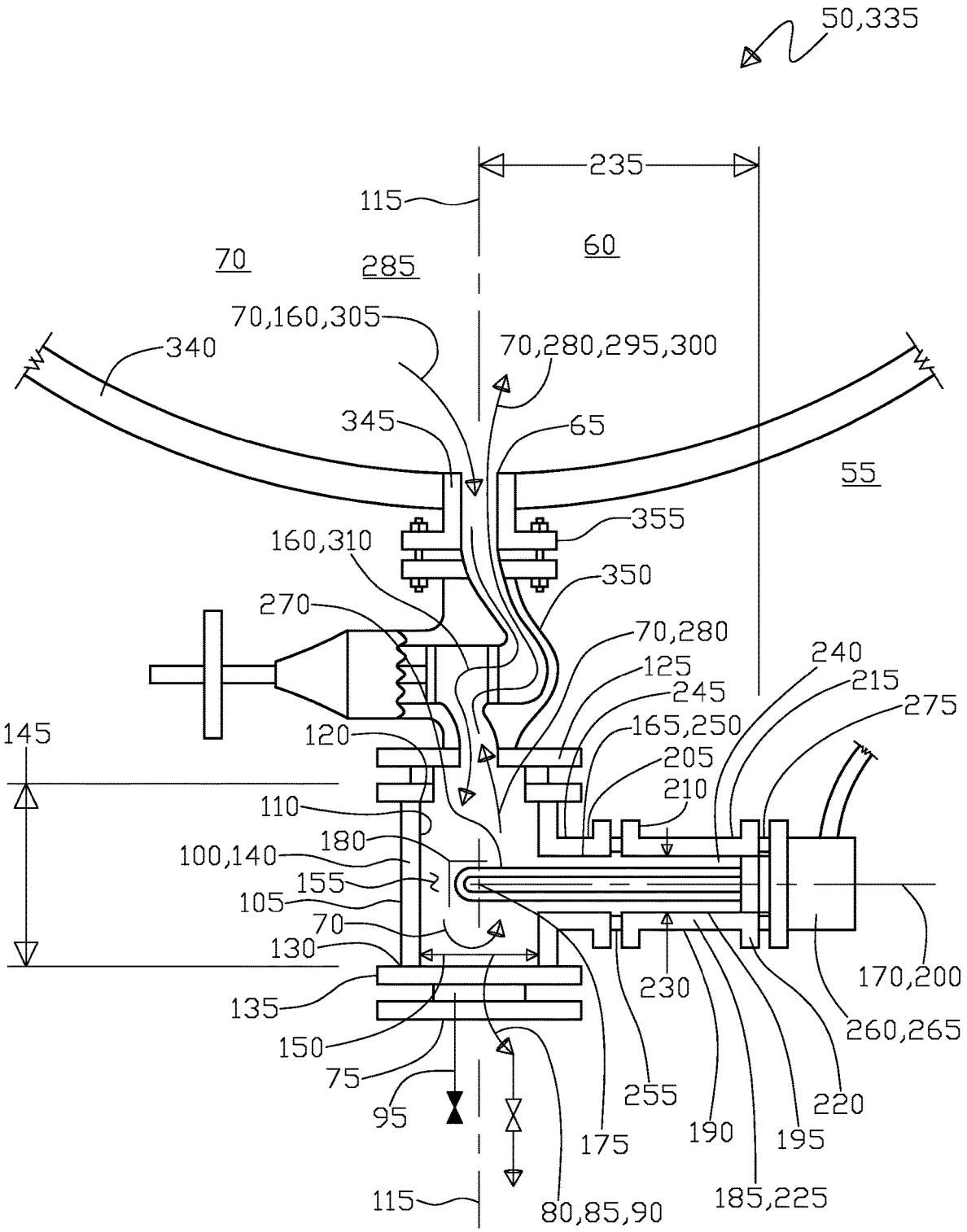
FIG. 9 is cross sectional view 9-9 from both FIGS. 6 and 8, with FIG. 9 showing the present invention of the fluid heating apparatus that includes the exterior of a primary fluid system with the drain, the drain valve, and the vessel, wherein the drain valve is in selectable fluid communication with the secondary fluid consumption system (not shown), further shown on the fluid heating apparatus is the means for imparting heat energy to the fluid in the form of an electric resistance heater along with the first and second surrounding sidewalls, the first and second proximal end portions, and the first and second distal end portions, FIG. 9 also shows the fluid flows from the vessel to the first and second interiors and returning to the vessel.

Moving onward, FIG. 9 is cross sectional view 9-9 from both FIGS. 6 and 8, with FIG. 9 showing the present invention of the fluid heating apparatus 50 that includes the exterior 55 of a primary fluid system 60 with the drain 65, the drain valve 350, and the vessel 340, wherein the drain valve 350 is in selectable fluid communication with the secondary fluid consumption system 75 (not shown), further shown on the fluid heating apparatus 50 is the means 260 for imparting heat energy to the fluid 70 in the form of an electric resistance heater 265 along with the first 100 and second 185 surrounding sidewalls, the first 120 and second 205 proximal end portions, and the first 130 and second 215 distal end portions, FIG. 9 also shows the fluid 70 flows 160, 305 from the vessel 340 to the first 155 and second 240 interiors and returning 280, 295 to the vessel 340.

Figure 10:
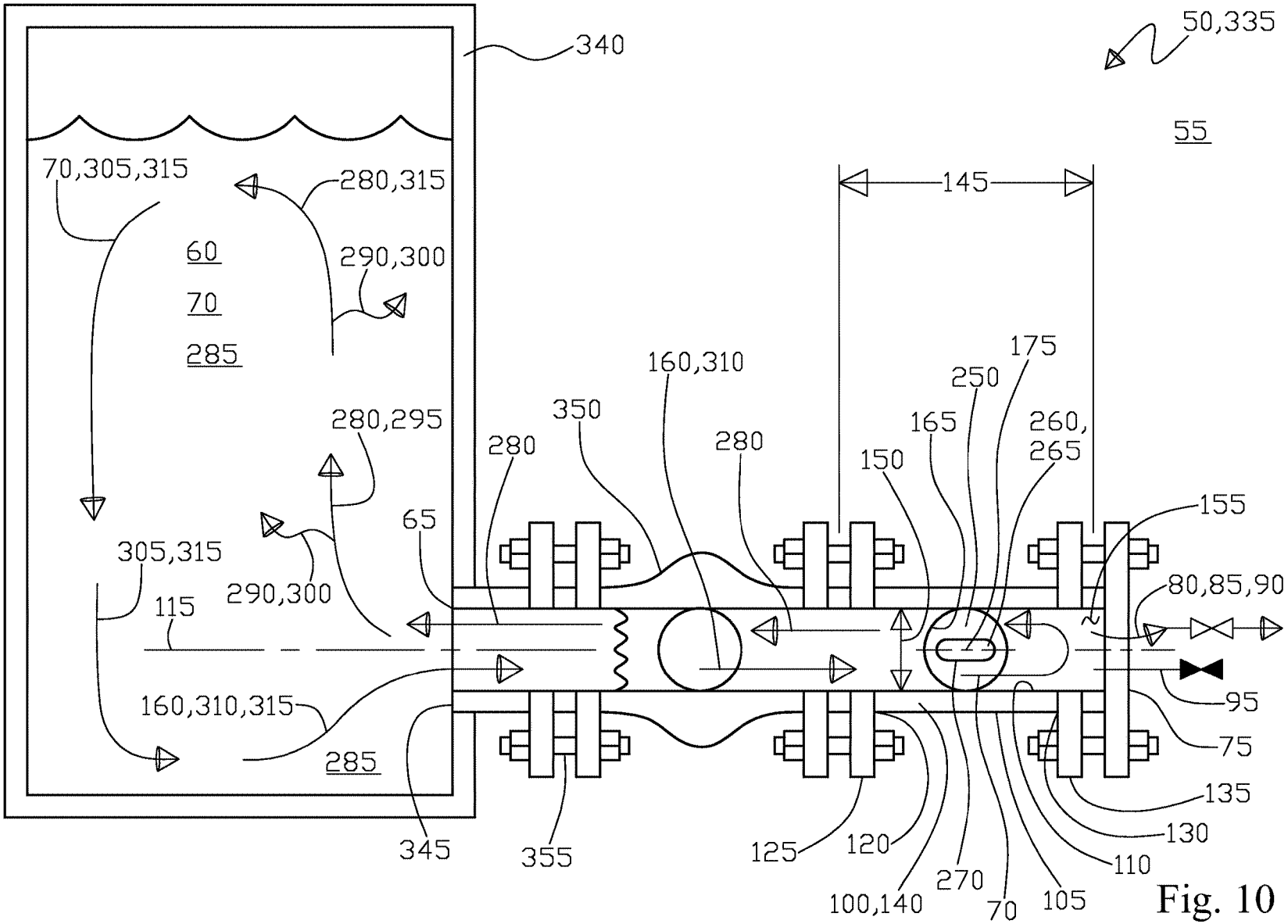
FIG. 10 is cross sectional view 10-10 from both FIGS. 6 and 8, with FIG. 10 showing the present invention of the fluid heating apparatus that includes the exterior of a primary fluid system with the drain, the drain valve, and the vessel, wherein the drain valve is in selectable fluid communication with the secondary fluid consumption system (not shown), further shown on the fluid heating apparatus is the means for imparting heat energy to the fluid in the form of an electric resistance heater along with the first and second surrounding sidewalls, the first and second proximal end portions, and the first and second distal end portions, FIG. 10 also shows the fluid flows from the vessel to the first and second interiors and returning to the vessel.

Further, FIG. 10 is cross sectional view 10-10 from both FIGS. 6 and 8, with FIG. 10 showing the present invention of the fluid heating apparatus 50 that includes the exterior 55 of a primary fluid system 60 with the drain 65, the drain valve 350, and the vessel 340, wherein the drain valve 350 is in selectable fluid communication with the secondary fluid consumption system 75 (not shown), further shown on the fluid heating apparatus 50 is the means 260 for imparting heat energy to the fluid 70 in the form of an electric resistance heater 265 along with the first 100 and second 185 surrounding sidewalls, the first 120 and second 205 proximal end portions, and the first 130 and second 215 distal end portions, FIG. 10 also shows the fluid 70 flows 160, 305 from the vessel 340 to the first 155 and second 240 interiors and returning 280, 295 to the vessel 340.

Broadly, in looking at FIGS. 6 to 10, the present invention is the enclosure that includes the fluid heating apparatus 50 for the primary fluid system 60 containing the fluid 70, the fluid heating apparatus 50 including the first surrounding sidewall 100 having a first outer portion 105 and an opposing first inner portion 110, with the first surrounding sidewall 100 being about a longitudinal axis 115, the first surrounding sidewall 100 having a first proximal end portion 120 and an opposing first distal end portion 130 with the longitudinal axis 115 spanning therebetween, as best shown in FIGS. 5, 6, and 8. The first surrounding sidewall 100 first proximal end portion 120, first inner portion 110, and first distal end portion 130 defining the first interior 155, wherein the first proximal end portion 120 is adapted to facilitate the first fluid communication 160 from the primary fluid system 60 therethrough the drain 65 of the primary fluid system 60 to the first interior 155 and the first distal end portion 130 which is adapted to facilitate a selectable 85 second fluid communication 80 to the secondary consumption fluid system 75 from the first interior 155, as best shown in FIGS. 5, 6, 8, 9, and 10. Wherein the selectable 85 second fluid communication 80 has a selectable open state 90 and a selectable closed state 95 to the secondary fluid consumption system 75, the first surrounding sidewall 100 also including a first aperture 165 disposed therethrough from the first outer portion 105 to the first inner portion 110, also the first aperture 165 being about a lengthwise axis 170, with the lengthwise axis 170 being disposed therethrough the first aperture 165 wherein the lengthwise axis 170 intersects the longitudinal axis a first intersection point 175, see FIGS. 8 and 9.

The fluid heating apparatus further includes the second surrounding sidewall 185 having a second outer portion 190 and an opposing second inner portion 195, with the second surrounding sidewall 185 being about the lengthwise axis 170, the second surrounding sidewall 185 having the second proximal end portion 205 and the opposing second distal end portion 215 with the lengthwise axis 170 spanning therebetween, as best shown in FIG. 8. The second proximal end portion 205, second inner portion 195, and second distal end portion 215 defining the second interior 240, the second proximal end portion 245 is affixed to the first surrounding sidewall 100 such that there is a third fluid communication 250 between the first interior 155 and the second interior 240 therethrough the first aperture 165, see in particular FIGS. 9 and 10.

The fluid heating apparatus 50 additionally includes the means 260 for imparting heat energy that is disposed within both the first interior 155 and the second interior 240, wherein operationally the fluid 70 is disposed within the primary fluid system 60, the first interior 155, and the second interior 240, see FIGS. 8, 9, and 10. Wherein the means 260 for imparting heat energy initially directly 280 heats the fluid 70 within the first 155 and second 240 interiors thereby causing a warmed fluid 70 heat transfer convection 290 through heat transfer conduction causing advection via thermal expansion of the fluid 70 causing buoyancy forces 300 within the fluid 70 resulting in a natural convection created from a reduction in density 300 of the directly heated fluid 70 relative to a higher density 305 of the non-directly heated fluid 70 thus causing fluid circulation 310, 315, from the first 155 and second 240 interiors to the primary fluid system 60 wherein the fluid 70 heat dissipates 305 increasing the fluid 70 density thus facilitating return 310 of a portion of the fluid 70 from the primary fluid system 60 to the first 155 and second 240 interiors to form a circulation loop 315 to dissipate the heat energy from the means 260 to the primary fluid system 60, see in particular FIGS. 9 and 10.

As an alternative for the fluid heating apparatus 50 wherein the first surrounding sidewall 100 is constructed of a larger diameter pipe section 140 with the first proximal end portion 120 constructed of a first proximal flange 125 and the first distal end portion 130 is constructed of a first distal flange 135, wherein the first aperture 165 further comprises a first aperture flange 255 disposed on the first outer portion 105, further the second surrounding sidewall 185 is constructed of a smaller diameter pipe section 225 with the second proximal end portion 205 constructed of a second proximal flange 210 and the second distal end portion 215 is constructed of a second distal flange 220, again see in particular FIG. 8, plus FIGS. 9 and 10. The first aperture flange 255 is affixed 255 to the second proximal flange 210, wherein structurally the first interior 155 is larger than the second interior 240 such that operationally the first interior 155 facilitates the natural convection 315 of the fluid 70 via the first interior 155 creating the fluid 70 density difference 305 around the means 260 for imparting heat energy within the first interior 155, again see in particular FIG. 8, plus FIGS. 9 and 10.

Another alternative for the fluid heating apparatus 50 wherein the means 260 for imparting heat energy is preferably constructed of an electric resistance heater 265 that is removably engaged 275 to the second distal flange 220 wherein the electric resistance heater 265 includes a heating element 270 that extends therethrough both the first 155 and second 240 interiors, see in particular FIGS. 9 and 10.

An option for the fluid heating apparatus 50 wherein the first intersection point 175 has the lengthwise axis 200 and the longitudinal axis 115 preferably being positioned substantially perpendicular 180 to one another, see FIGS. 8 and 9.

Another option for the fluid heating apparatus 50 wherein the larger diameter pipe section 140 has a first diameter 150 and the smaller diameter pipe section 225 has a second diameter 230 such that a ratio of the first diameter 150 to the second diameter 230 is in the range of about three (3) though four (4) to one (1), see in particular FIG. 9.

A further option for the fluid heating apparatus 50 wherein the smaller diameter pipe section 225 has a second axial length 235, wherein a ratio of the second axial length 235 to the first diameter 150 is in the range of about one (1) to one (1) structurally resulting in the heating element 270 being disposed about equally within each of the first 155 and second 240 interiors, see in particular FIG. 9.

A yet further option for the fluid heating apparatus 50 wherein the larger diameter pipe section 140 has a first axial length 145, wherein a ratio of the first axial length 145 to the first diameter 150 is in the range of about one (1) to one (1) to operationally best facilitate the natural convection 315, see in particular FIG. 9.

A continuing option for the fluid heating apparatus 50 wherein the first 100 and second 185 surrounding sidewalls include a means for reducing heat transfer 320 from the heating element 265 to the external environment 55 wherein the means 320 for reducing heat transfer is disposed on the first 105 and second 190 outer portions, as best shown in FIGS. 4, 5, 6, and 7. In addition, optionally for the fluid heating apparatus 50 wherein the means 320 for reducing heat transfer is preferably constructed of the fiberglass mat layer 325 having the weatherproof outer cover 330, see in particular FIG. 7, plus FIGS. 4, 5, and 6.

As an alternative embodiment for the fluid heating apparatus system 335 for a primary feed fluid vessel 60 containing the fluid 70 to selectively feed the fluid 70 to the secondary fluid consumption system 75, with the fluid heating apparatus system 335 including a primary feed fluid vessel 340 that includes the drain connection 65 with a valve 350 with a selectable open state and a selectable closed state, wherein the vessel 340 contains the fluid 70, see FIGS. 1, 4, 5, 6, 7, 8, 9, and 10. Further included on the fluid heating apparatus system 335 is the secondary fluid consumption system 75 that utilizes the fluid 70 plus the first surrounding sidewall 100 having the first outer portion 105 and the opposing first inner portion 110, with the first surrounding sidewall 100 being about the longitudinal axis 115, the first surrounding sidewall 100 having the first proximal end portion 120 and the opposing first distal end portion 130 with the longitudinal axis 115 spanning therebetween, see FIGS. 5, 6, 8, 9, and 10.

Also included on the fluid heating apparatus system 335 is the first proximal end portion 120, the first inner portion 110, and the first distal end portion 130 all defining the first interior 155, the first proximal end portion 120 is affixed 355 to the drain 65 of the vessel 340 to facilitate the first fluid communication 160 from the fluid 70 in the vessel 340 therethrough the drain 65 to the first interior 155 and the first distal end portion 130 is adapted to facilitate a selectable 85 second fluid communication 80 to the secondary fluid consumption system 75 from the first interior 155, see in particular FIGS. 9 and 10. Wherein the selectable 85 second fluid communication 80 has a selectable open state 90 and a selectable closed state 95 to the secondary fluid consumption system 75, the first surrounding sidewall 100 also including the first aperture 165 disposed therethrough from first outer portion 105 to the first inner portion 110, also the first aperture 165 being about the lengthwise axis 170, with the lengthwise axis 170 being disposed therethrough the first aperture 165 wherein the lengthwise axis 170 intersects the longitudinal axis 115 at the first intersection point 175, see FIGS. 8 and 9.

Further included on the fluid heating apparatus system 335 is the second surrounding sidewall 185 having the second outer portion 190 and the opposing second inner portion 195, with the second surrounding sidewall 185 being about the lengthwise axis 170, the second surrounding sidewall 185 having the second proximal end portion 205 and the opposing second distal end portion 215 with the lengthwise axis 170 spanning therebetween, see FIGS. 5, 6, 8, 9, and 10. The second proximal end portion 205, the second inner portion 195, and the second distal end portion 215 defining the second interior 240, the second proximal end portion 205 is affixed 245 to the first surrounding sidewall 100 such that there is the third fluid communication 250 between the first interior 155 and the second interior 240 therethrough the first aperture 165, as best shown in FIGS. 9 and 10.

In addition included on the fluid heating apparatus system 335 is the means 260 for imparting heat energy that is disposed within both the first interior 155 and the second interior 240, wherein operationally the fluid 70 is disposed within the primary fluid system 60, the first interior 155, and the second interior 240, see FIGS. 8, 9, and 10. Wherein the means 260 for imparting heat energy initially directly 280 heats the fluid 70 within the first 155 and second 240 interiors thereby causing a warmed fluid 70 heat transfer convection 290 through heat transfer conduction causing advection via thermal expansion of the fluid 70 causing buoyancy forces 300 within the fluid 70 resulting in a natural convection created from a reduction in density 300 of the directly heated fluid 70 relative to a higher density 305 of the non-directly heated fluid 70 thus causing fluid circulation 310, 315, from the first 155 and second 240 interiors to the primary fluid system 60 wherein the fluid 70 heat dissipates 305 increasing the fluid 70 density thus facilitating return 310 of a portion of the fluid 70 from the primary fluid system 60 to the first 155 and second 240 interiors to form a circulation loop 315 to dissipate the heat energy from the means 260 to the primary fluid system 60, see in particular FIGS. 9 and 10.

The means 260 for imparting heat energy to the fluid 70 is serviceable without the need for draining or disturbing the fluid 70 disposed within the primary fluid system 60 due to the first 155 and second 240 interiors being able to be isolated fluid communication wise in having a closed state (from the valve 350 being in the closed state) to prevent the first 160 fluid 70 communication as between the primary fluid system 60 and the first 155 and second 240 interiors, plus in addition the secondary fluid 70 consumption system 75 can be isolated in fluid communication from the first 155 and second 240 interiors via the closed state 95 to service (repair or replace the means 260 for imparting heat to the fluid 70).

CONCLUSION

Accordingly, the present invention of the fluid heating apparatus has been described with some degree of particularity directed to the embodiments of the present invention. It should be appreciated, though, that the present invention is defined by the following claims construed in light of the prior art so that modifications or changes may be made to the exemplary embodiments of the present invention without departing from the inventive concepts contained therein.

The invention claimed is:

1. A fluid heating apparatus for a primary fluid system containing a fluid, said fluid heating apparatus comprising:

(a) a first surrounding sidewall having a first outer portion and an opposing first inner portion, with said first surrounding sidewall being about a longitudinal axis, said first surrounding sidewall having a first proximal end portion and an opposing first distal end portion with said longitudinal axis spanning therebetween, said first proximal end portion, said first inner portion, and said first distal end portion defining a first interior, said first proximal end portion is adapted to facilitate a first fluid communication from the primary fluid system therethrough a drain of the primary fluid system to said first interior and said first distal end portion is adapted to facilitate a selectable second fluid communication to a secondary consumption fluid system from said first interior, wherein said selectable second fluid communication has a selectable open state and a selectable closed state to the secondary fluid consumption system, said first surrounding sidewall also including a first aperture disposed therethrough from said first outer portion to said first inner portion, also said first aperture being about a lengthwise axis, with said lengthwise axis being disposed therethrough said first aperture wherein said lengthwise axis intersects said longitudinal axis a first intersection point;

(b) a second surrounding sidewall having a second outer portion and an opposing second inner portion, with said second surrounding sidewall being about said lengthwise axis, said second surrounding sidewall having a second proximal end portion and an opposing second distal end portion with said lengthwise axis spanning therebetween, said second proximal end portion, said second inner portion, and said second distal end portion defining a second interior, said second proximal end portion is affixed to said to said first surrounding sidewall such that there is a third fluid communication between said first interior and said second interior therethrough said first aperture; and (c) an electric resistance heater for imparting heat energy to the fluid, wherein said electric resistance heater is disposed within both said first interior and said second interior, wherein operationally the fluid is disposed within the primary fluid system, said first interior, and said second interior, wherein said electric resistance heater for imparting heat energy initially directly heats the fluid within said first and second interiors thereby causing a warmed fluid heat transfer convection through heat transfer conduction causing advection via thermal expansion of the fluid causing buoyancy forces within the fluid resulting in a natural convection created from a reduction in density of the directly heated fluid relative to a lower density of the non-directly heated fluid thus causing fluid circulation from said first and second interiors to the primary fluid system wherein the fluid heat dissipates increasing the fluid density thus facilitating return of a portion of the fluid from the primary fluid system to said first and second interiors to form a circulation loop to dissipate said heat energy from said electric resistance heater to the primary fluid system.

2. A fluid heating apparatus according to claim 1 wherein said first surrounding sidewall is constructed of a larger diameter pipe section with said first proximal end portion constructed of a first proximal flange and said first distal end portion is constructed of a first distal flange, wherein said first aperture further comprises a first aperture flange disposed on said first outer portion, further said second surrounding sidewall is constructed of a smaller diameter pipe section with said second proximal end portion constructed of a second proximal flange and said second distal end portion is constructed of a second distal flange, said first aperture flange is affixed to said second proximal flange, wherein structurally said first interior is larger than said second interior such that operationally said first interior facilitates said natural convection of the fluid via said first interior creating said fluid density difference around said electric resistance heater for imparting heat energy within said first interior.

3. A fluid heating apparatus according to claim 2 wherein said electric resistance heater is removably engaged to said second distal flange wherein said electric resistance heater includes a heating element that extends therethrough both said first and second interiors.

4. A fluid heating apparatus according to claim 3 wherein said first intersection point has said lengthwise axis and said longitudinal axis positioned substantially perpendicular to one another.

5. A fluid heating apparatus according to claim 4 wherein said larger diameter pipe section has a first diameter and said smaller diameter pipe section has a second diameter such that said first diameter is three (3) to four (4) times in size of said second diameter size, wherein operationally, said first and second diameter size relationship further enhances said first interior facilitating said natural convection of the fluid via said first interior creating said fluid density difference around said heating element for imparting heat energy within said first interior.

6. A fluid heating apparatus according to claim 4 wherein said smaller diameter pipe section has a second axial length, wherein said second axial length is equal to said first diameter positionally resulting in said heating element being disposed about equally within each of said first and second interiors, wherein operationally, said second axial length equaling said first diameter relationship further enhances said first interior facilitating said natural convection of the fluid via said first interior creating said fluid density difference around said heating element for imparting heat energy within said first interior.

7. A fluid heating apparatus according to claim 4 wherein said larger diameter pipe section has a first axial length, wherein said first axial length is equal to said first diameter, wherein operationally, said first axial length equaling said first diameter relationship further enhances said first interior facilitating said natural convection of the fluid via said first interior creating said fluid density difference around said heating element for imparting heat energy within said first interior.

8. A fluid heating apparatus according to claim 4 wherein said first and second surrounding sidewalls include a means for reducing heat transfer from said heating element to an external environment wherein said means for reducing heat transfer is disposed on said first and second outer portions.

9. A fluid heating apparatus according to claim 8 wherein said means for reducing heat transfer is constructed of a fiberglass mat layer having a weatherproof outer cover.

10. A fluid heating apparatus system for a primary feed fluid vessel containing a fluid to selectively feed the fluid to a secondary fluid consumption system, said fluid heating apparatus system comprising:

(a) a primary feed fluid vessel that includes a drain connection with a drain valve having a selectable open state and a selectable closed state, wherein said vessel contains a fluid;

(b) a secondary fluid consumption system that utilizes the fluid;

(c) a first surrounding sidewall having a first outer portion and an opposing first inner portion, with said first surrounding sidewall being about a longitudinal axis, said surrounding sidewall having a first proximal end portion and an opposing first distal end portion with said longitudinal axis spanning therebetween, said first proximal end portion, said first inner portion, and said first distal end portion defining a first interior, said first proximal end portion is affixed to said drain of said vessel to facilitate a first fluid communication from the fluid in said vessel therethrough said drain to said first interior and said first distal end portion is adapted to facilitate a selectable second fluid communication to said secondary fluid consumption system from said first interior, wherein said selectable second fluid communication has a selectable open state and a selectable closed state to the secondary fluid consumption system, said first surrounding sidewall also including a first aperture disposed therethrough from said first outer portion to said first inner portion, also said first aperture being about a lengthwise axis, with said lengthwise axis being disposed therethrough said first aperture wherein said lengthwise axis intersects said longitudinal axis a first intersection point;

(d) a second surrounding sidewall having a second outer portion and an opposing second inner portion, with said second surrounding sidewall being about said lengthwise axis, said second surrounding sidewall having a second proximal end portion and an opposing second distal end portion with said lengthwise axis spanning therebetween, said second proximal end portion, said second inner portion, and said second distal end portion defining a second interior, said second proximal end portion is affixed to said to said first surrounding sidewall such that there is a third fluid communication between said first interior and said second interior therethrough said first aperture; and (e) an electric resistance heater for imparting heat energy to the fluid, wherein said electric resistance heater is disposed within both said first interior and said second interior, wherein operationally the fluid is disposed within said vessel, said first interior, and said second interior, wherein said electric resistance heater for imparting heat energy initially directly heats the fluid within said first and second interiors thereby causing a warmed fluid heat transfer convection through heat transfer conduction causing advection via thermal expansion of the fluid causing buoyancy forces within the fluid resulting in a natural convection created from a reduction in density of the directly heated fluid relative to a lower density of the non-directly heated fluid thus causing fluid circulation from said first and second interiors to the vessel wherein the fluid heat dissipates within said vessel dropping the fluid density thus facilitating return of a portion of the fluid from the primary fluid system to said first and second interiors to form a circulation loop to dissipate said heat energy from said electric resistance heater to the vessel.

11. A fluid heating apparatus according to claim 10 wherein said first surrounding sidewall is constructed of a larger diameter pipe section with said first proximal end portion constructed of a first proximal flange and said first distal end portion is constructed of a first distal flange, wherein said first aperture further comprises a first aperture flange disposed on said first outer portion, further said second surrounding sidewall is constructed of a smaller diameter pipe section with said second proximal end portion constructed of a second proximal flange and said second distal end portion is constructed of a second distal flange, said first aperture flange is affixed to said second proximal flange, wherein structurally said first interior is larger than said second interior such that operationally said first interior facilitates said natural convection of the fluid via said first interior creating said fluid density difference around said electric resistance heater for imparting heat energy within said first interior.

12. A fluid heating apparatus according to claim 11 wherein said electric resistance heater is removably engaged to said second distal flange wherein said electric resistance heater includes a heating element that extends therethrough both said first and second interiors, wherein operationally with said drain valve in said closed state said electric resistance heater can be removed at said second distal flange without draining the fluid from said vessel.

13. A fluid heating apparatus according to claim 12 wherein said first intersection point has said lengthwise axis and said longitudinal axis positioned substantially perpendicular to one another.

14. A fluid heating apparatus according to claim 13 wherein said larger diameter pipe section has a first diameter and said smaller diameter pipe section has a second diameter such that said first diameter is three (3) to four (4) times in size of said second diameter size, wherein operationally, said first and second diameter size relationship further enhances said first interior facilitating said natural convection of the fluid via said first interior creating said fluid density difference around said heating element for imparting heat energy within said first interior.

15. A fluid heating apparatus according to claim 14 wherein said smaller diameter pipe section has a second axial length, wherein said second axial length is equal to said first diameter positionally resulting in said heating element being disposed about equally within each of said first and second interiors, wherein operationally, said second axial length equaling said first diameter relationship further enhances said first interior facilitating said natural convection of the fluid via said first interior creating said fluid density difference around said heating element for imparting heat energy within said first interior.

16. A fluid heating apparatus according to claim 15 wherein said larger diameter pipe section has a first axial length, wherein said first axial length is equal to said first diameter, wherein operationally, said first axial length equaling said first diameter relationship further enhances said first interior facilitating said natural convection of the fluid via said first interior creating said fluid density difference around said heating element for imparting heat energy within said first interior.

17. A fluid heating apparatus according to claim 16 wherein said first and second surrounding sidewalls include a means for reducing heat transfer from said heating element to an external environment wherein said means for reducing heat transfer is disposed on said first and second outer portions.

18. A fluid heating apparatus according to claim 17 wherein said means for reducing heat transfer is constructed of a fiberglass mat layer having a weatherproof outer cover.

* * * * *